US007788901B2

(12) United States Patent
Huang

(10) Patent No.: US 7,788,901 B2
(45) Date of Patent: Sep. 7, 2010

(54) APPARATUS AND METHOD FOR REGENERATING EXHAUST TREATMENT DEVICES

(75) Inventor: Yiqun Huang, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 679 days.

(21) Appl. No.: 11/676,441

(22) Filed: Feb. 19, 2007

(65) Prior Publication Data

US 2008/0196391 A1 Aug. 21, 2008

(51) Int. Cl.
*F01N 3/00* (2006.01)

(52) U.S. Cl. ..... 60/274; 60/280; 60/285; 60/286; 60/295

(58) Field of Classification Search ..... 60/274, 60/280, 284, 285, 286, 295, 297
See application file for complete search history.

(56) References Cited

U.S. PATENT DOCUMENTS 5,642,705 A * 7/1997 Morikawa et al. ..... 123/300
6,041,591 A * 3/2000 Kaneko et al. ..... 60/274
6,293,095 B1 * 9/2001 Yamamoto et al. ..... 60/286
6,314,935 B2 * 11/2001 Tanaka et al. ..... 123/298
6,705,077 B2 3/2004 Uedahira et al.
6,736,595 B2 5/2004 Jinnai et al.
6,751,948 B2 * 6/2004 Takemura et al. ..... 60/284
6,976,356 B2 * 12/2005 Okada et al. ..... 60/286
7,107,770 B2 9/2006 Shirakawa
7,159,389 B2 1/2007 Miura
7,168,243 B2 1/2007 Endicott et al.
7,197,867 B2 4/2007 Huang et al.

OTHER PUBLICATIONS

W. Addy Majewski. "Diesel Particulate Filters". DieselNet Technology Guide. www.DieselNet.com. Copyright © Ecopoint Inc. Revision 2001.07b. Internet printout dated Feb. 17, 2007. 11pgs.
"Diesel Filter Regeneration". DieselNet Technology Guide >> Diesel Particulate Filters. www.DieselNet.com. Copyright © Ecopoint Inc. Revision 2005.06a. Internet printout dated Feb. 17, 2007. 16pgs.
Ignition Timing. Century Performance Center. "Your Vehicle's Ignition System and Timing Settings". www.centuryperformance.com/timing.asp. Tel: 775-746-4887. Copyright © 1999, 2000, 2001, 2002, 2003, 2004, & 2005. Century Performance Center. Last modified: Mar. 31, 2006. Internet printout dated Feb. 17, 2007. 9pgs.
"Ignition Timing". From Wikipedia, the free encyclopedia. http://enwikipedia.org/wiki/Ignition_timing. Category: Engine technology. Last modified: 04:55, Dec. 17, 2006. Wikipedia® is a registered trademark of the Wikimedia Foundation, Inc., a US-registered 501(c)(3) tax-deductible nonprofit charity. Internet printout dated Feb. 17, 2007. 4pgs.

(Continued)

*Primary Examiner*—Binh Q. Tran
(74) *Attorney, Agent, or Firm*—Grossman Tucker et al

(57) ABSTRACT

A method and apparatus for regenerating exhaust treatment devices. Incomplete combustion products may be selectively provided in at least one cylinder of multi-cylinder internal combustion engine. This may then be followed by directing the products to an engine exhaust treatment device. The temperature of the engine exhaust treatment device may then be increased due to exposure to the products of incomplete combustion. The catalyst in the converter may then be regenerated due to the temperature increase.

25 Claims, 5 Drawing Sheets

OTHER PUBLICATIONS

DCL International Inc.: Diesel Oxidation Catalyst. "Diesel Oxidation Catalyst". http://www.dcl-inc.com/catdiesel.cfm? Ig=EN. Copyright 2005-2006 DCL International Inc. All Rights Reserved. Internet printout dated Feb. 17, 2007. 1pg.

W. Addy Majewski. "NOx Adsorbers". DieselNet Technology Guide >>Diesel Catalysts. www.DieselNet.com. Copyright © Ecopoint Inc. Revision 2002.09a. Internet printout dated Feb. 17, 2007. 20pgs.

"NOx Adsorbers". From Wikipedia, the free encyclopedia. http://enwikipedia.org/wiki/NOx_Adsorbers. Categories: Physical Chemistry/Engine Technology. Last modified: 17:53, Jan. 29, 2007. Wikipedia® is a registered trademark of the Wikimedia Foundation, Inc., a US-registered 501(c)(3) tax-deductible nonprofit charity. Internet printout dated Feb. 16, 2007. 1pg.

Technologies—NOx Adsorber Catalysts. Johnson Matthey. Environmental Catalysts And Technologies. "NOx adsorber catalysts/NOx traps". http://ect.jmcatalysts.com/technologies-nox.htm. Internet printout dated Feb. 16, 2007. 2pgs.

DNT Selective Catalytic Reduction. "Selective Catalytic Reduction (SCR)". http://www.de-nox.com/SCR.htm. Internet printout dated Feb. 16, 2007. 2pgs.

Diesel Particulate Filter—Wikipedia, the free encyclopedia. "Diesel Particulate Filter". From Wikipedia, the free encyclopedia (Redirected from Diesel Particulate Filter). http://en.wikipedia.org/wiki/Diesel-Particulate_Filter. Last modified: 15:40, Feb. 7, 2007. Wikipedia® is a registered trademark of the Wikimedia Foundation, Inc., a US-registered 501(c)(3) tax-deductible nonprofit charity. Internet printout dated Feb. 16, 2007. 5pgs.

Marshall Brian. Howstuffworks-Producing More Engine Power. "How Car Engines Work". htpp://auto.howstuffworks.com/engine7.htm. Internet printout Feb. 15, 2007. 2pgs.

Marshall Brian. Howstuffworks-How Horsepower Works. "How Horsepower Works". htpp://howstuffworks.com/horsepower.htm. Internet printout Feb. 15, 2007. 3pgs.

HSE-Publications-Diesel Engine Exhaust Emissions. Diesel Engine Exhaust Emissions. "What Are Diesel Engine Exhaust Emissions?". htpp://www.hse.gov.uk/pubns/indg286.htm. HSE Books, PO Box 1999, Sudbury, Suffolk, CO 106FS. Printed and published by the Health and Safety Executive. Added to the HSE website on Jun. 2, 1999. Internet printout dated Feb. 15, 2007. 4 pgs.

Catalytic Converter-Wikipedia, the free encyclopedia. "Catalytic Converter". From Wikipedia, the free encyclopedia. http://enwikipedia.org/wiki/Catalytic_converter. Last modified: 17:11, Feb. 12, 2007. Wikipedia® is a registered trademark of the Wikimedia Foundation, Inc., a US-registered 501(c)(3) tax-deductible nonprofit charity. Internet printout dated Feb. 14, 2007. 10pgs.

U.S. Department of Energy FreedomCAR and Vehicle Technologies Program Engine and Emission Control Technologies. "Desulfation Temperature Prime Deactivation Mechanism for Lean NOx Trap". Oak Ridge National Laboratory is operated by UT-Battelle, LLC, for the U.S. Department of Energy. Tel: 865-946-1207. toopstj@ornl.gov. Mar. 2005. 2pgs.

C.S. Daw, et al. "Observing and Modeling Nonlinear Dynamics in an Internal Combustion Engine". Physical Review E. vol. 57, No. 3. Engineering Technology Division, Oak Ridge National Laboratory, P.O. Box 2009, Oak Ridge, TN 37831-8088. dawcs@ornl.gov. © 1998 The American Physical Society. Mar. 1998. 9pgs.

D.H. Kim, et al. "Investigation of SO2 Poisoning and Thermal Aging Mechanisms For Pt/BaO3/Al2O3 Lean NOx Trap Catalysts". Printout 1pg.

Andreas Mayr, et al. "Diesel Fuel Vaporizer: a Way to Reliable DPF Regeneration". Marco Ranalli, concepts and new technologies, Center of Competence—Emissions. marco.ranalli@arvinmeritor.com. Zeuna Staerker GmbH & Co.KG, Biberbachstrasse 9 D-86154, Augsburg, Germany. Printout 6pgs.

* cited by examiner

APPARATUS AND METHOD FOR REGENERATING EXHAUST TREATMENT DEVICES

FIELD OF THE INVENTION

The present disclosure relates to an apparatus and method for improving the performance of an exhaust treatment device. The method may include raising the temperature of such device wherein the increase in temperature may improve the ensuing efficiency of operation by improving the efficacy of a device catalyst. For example, catalysts that may be utilized in catalytic converters such as a converter used to reduce nitrogen oxide (NOx) and/or a catalyst that may be used in a diesel particulate filter (DPF).

BACKGROUND OF THE INVENTION

Internal combustion engines such as those found in cars and trucks may produce combustion byproducts and/or products of incomplete combustion which may be in the engine exhaust and emitted into the environment. Pursuant to emissions regulations, the exhaust may be treated to reduce the concentration of such products and, therefore, reduce pollution. Although spark ignition (i.e., gasoline) engines may use three-way catalytic converters to satisfy emissions regulations, compression ignition (i.e., diesel) engines typically employ two-way catalytic converters which may not efficiently reduce nitrogen oxides ($NO_x$). Accordingly, diesel engines may include selective catalytic reduction (SCR) systems in order to seek reduction in nitrogen oxide concentrations. In addition, diesel engines may also include diesel particulate filters (DPF) for particulate matter (PM) control. Improving the performance of such systems remains an ongoing area of research and development.

SUMMARY OF THE INVENTION

The present disclosure relates to a method and apparatus for regenerating exhaust treatment devices. Incomplete combustion products (e.g. hydrocarbon and/or carbon monoxide) may be selectively provided in a cylinder of an internal combustion engine. This may then be followed by directing the products to an engine exhaust treatment device. The temperature of the engine exhaust treatment device may then be increased due to exposure to the products of incomplete combustion and catalytic exothermic reactions. The catalyst in the converter may then be regenerated due to the temperature increase. In apparatus form, the disclosure relates to a computer program product residing on a computer readable medium having instructions stored thereon, when executed by a processor, cause the processor to monitor an exhaust treatment device, instruct for incomplete combustion in a cylinder of an internal combustion engine and identify if an increase in temperature has occurred in the exhaust treatment device.

BRIEF DESCRIPTION OF THE DRAWINGS

The above-mentioned and other features and advantages of the present disclosure, and the manner of attaining them, will become more apparent and the disclosure will be better understood by reference to the following description in conjunction with the accompanying drawings, wherein.

DETAILED DESCRIPTION OF THE INVENTION

Figure 1:
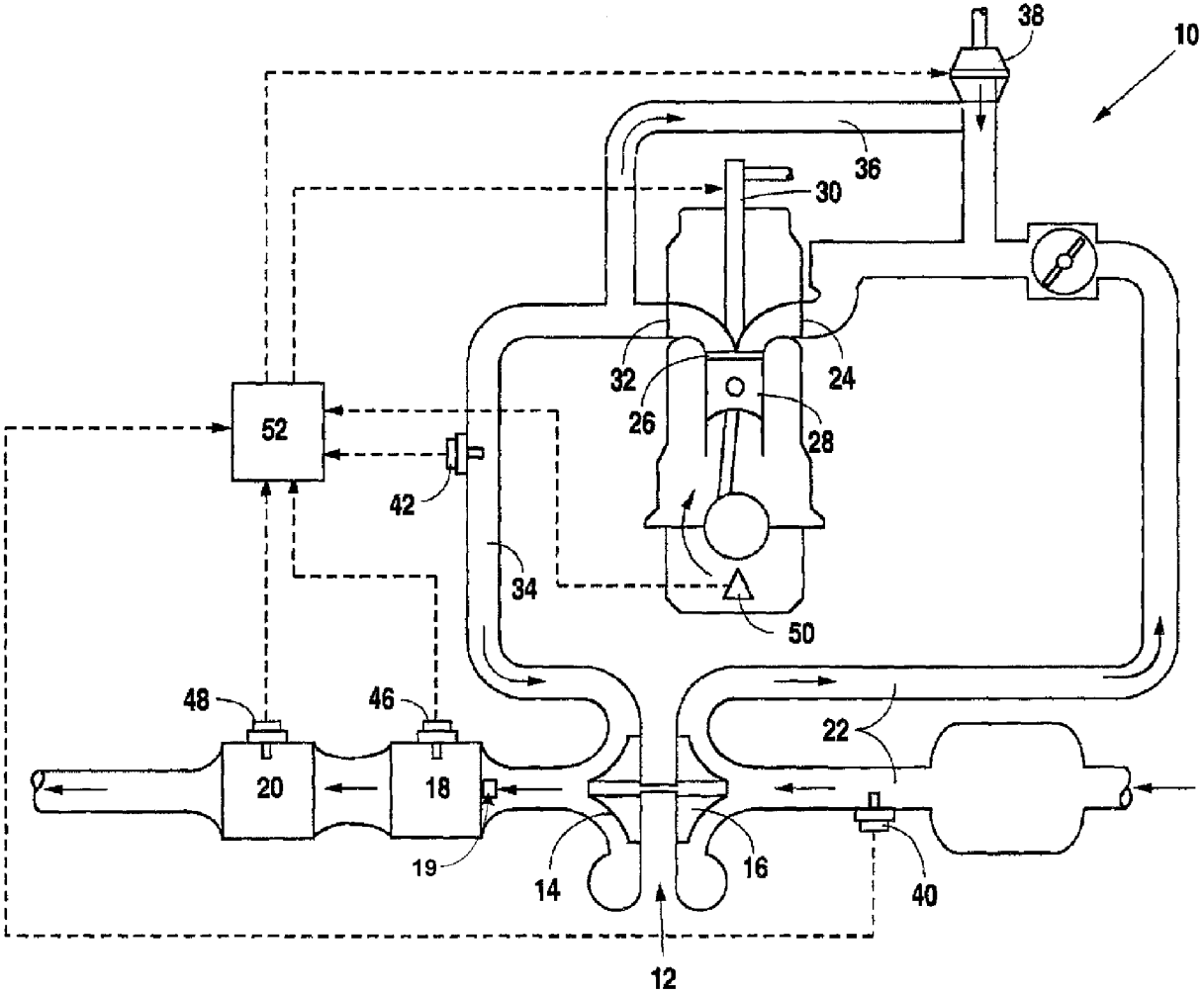
FIG. 1 illustrates an exemplary diesel engine configuration.

The present disclosure relates to a method and apparatus for regenerating an exhaust treatment device (ETD). As alluded to above, this may include selectively generating incomplete combustion in a cylinder of an internal combustion engine and directing the cylinder output to the ETD to promote catalyst regeneration. A cylinder may therefore be understood as any location wherein fuel combustion may take place.

The exhaust may therefore include the exhaust stream of an internal combustion engine. For example, it may include a diesel engine that relies upon compression ignition. However, the present invention may be understood to be applicable to any type of exhaust, vehicular or otherwise, wherein the control of emissions, such as $NO_x$ emissions, and/or the control of particulate emissions, may be desired. This therefore contemplates the exhaust that may be found from the flue gases of boilers, such as boilers used in power generation. Furthermore, the present invention may also be applicable to situations where $NO_x$ may be produced and not necessarily as the direct output of an exhaust system, but nonetheless desirably converted to other relatively less toxic compounds.

Exhaust products, which therefore serve as one example of a system that produces $NO_x$ emissions, may be understood to include volatile organic compounds (VOCs) such as hydrocarbons ($C_xH_y$). Products may also include gases such as carbon monoxide (CO). Products may further include nitrogen oxides ($NO_x$) such as nitric oxide (NO) and/or nitrogen dioxide ($NO_2$), both of which may contribute to smog formation and/or acid rain. An exemplary exhaust system may therefore include one or a plurality of catalyst systems to react such products (i.e., hydrocarbons, carbon monoxide, and nitrogen oxides) to yield relatively less toxic products of carbon dioxide ($CO_2$), water vapor ($H_2O$), and nitrogen gas ($N_2$).

An exhaust treatment device herein may therefore include a variety of catalyst converter systems which may assist in the reaction and formation of relatively less toxic compounds. For example, a $NO_x$ adsorber catalytic converter may be understood as a lean NOx trap (LNT), which is reference to a trap that may operate in two alternative phases: a storage mode and a regeneration mode. During the storage phase, the operation of the engine may produce a reductant-lean exhaust in which the $NO_x$ may be oxidized and stored on a catalyst, referred to as a NOx adsorber. The storage phase may last from about 30 seconds to about 10 minutes. The regeneration phase herein may last from about 1 to about 60 seconds, and may be "invisible" to the user and be implemented via a control unit that monitors engine and exhaust treatment device operation.

In addition, it may now be appreciated that in such fashion one may avoid the need for techniques such as post-injection and in-exhaust fuel injection to increase catalyst bed temperatures. One may also avoid the need to operate the cylinders in a lean combustion mode followed by a rich combustion mode. In addition, by avoiding such techniques, one may avoid their associated operational problems, such as the need for separate hardware.

Expanding upon the above, while $NO_x$ adsorbers are effective at adsorbing $NO_x$, they have a relatively high affinity for sulfur and may be susceptible to "sulfur poisoning." As such, sulfur from fuel and possibly engine lubricant (containing. $SO_2$) can adsorb to $NO_x$ adsorbent sites. Sulfur removal (desulfurization) therefore may require that the $NO_x$ adsorbers periodically undergo an elevated temperature treatment (e.g. 500° C.-700° C.) to maintain relatively useful $NO_x$ adsorber performance. Therefore, it may be appreciated that for a given $NO_x$ catalytic adsorber, such adsorber may, after a period of operation, accumulate to a given level of sulfur content. Therefore, subsequent to exposure to the products of incomplete combustion noted herein, the catalyst may now undergo an exothermic reaction and increase to temperatures suitable for desulfurization, thereby reducing the sulfur content and regenerating the catalyst for subsequent use in exhaust treatment.

$NO_x$ type catalytic adsorbers contemplated herein include any catalyst that is designed to reduce oxides of nitrogen. This then may include those catalysts who supply a surface for reacting $NO_x$ and which may allow for sulfur reduction at a selected temperature. In the case of a lean nitrous oxide trap, such may include three active components: (1) an oxidation catalyst, for example Pt; (2) an adsorbant, for example barium oxide (BaO); and (3) a reduction catalyst, e.g. rhodium (Rh).

Another exemplary exhaust treatment device that may be employed herein may include a diesel particulate filter (DPF) which may be located in an inlet exhaust pipe to specifically reduce diesel particulate matter (PM) such as soot, which may have sub-micron size (<1.0 μm) and a bulk density of less than about 0.1 g/cm$^3$. A diesel particulate filter may therefore force exhaust through a filter wall to collect particulate matter. It may therefore be appreciated that a DPF filter may be configured to burn off (oxidize) accumulated particulate (soot), and may accomplish this task through the use of a catalyst. More specifically, a catalytic oxidizer which may increase the exhaust temperature in the presence of a fuel source (e.g. HC or CO). A variety of DPF filters are therefore contemplated for use herein, such as a filter made of cordierite (ceramic material), silicon carbide type filters, and/or metal fiber flow through filters. The DPF filter may therefore combusts the particulate matter container therein (and regenerate) when reaching temperatures of at or above about 600° C.

An exemplary diesel engine is now illustrated in FIG. 1. As shown therein the engine 10 may be equipped with a turbocharger 12 that has a turbine stage 14 driven by exhaust gas and coupled to a compressor stage 16 for the purpose of compressing intake air prior to introduction into the engine. Also, the engine 10 may have a diesel particulate filter 18 that may be disposed downstream of the turbine stage 14 and a $NO_x$ trap 20 that may be positioned downstream of the diesel particulate filter 18 and a diesel oxidation catalyst 19 may be present in front of the DPF. A flow of compressed intake air may be directed through an intake conduit 22 to an intake port 24 of the engine 10. Fuel may then be introduced into a combustion chamber 26 having a piston 28 by a fuel injector 30. After combustion of a controlled air/fuel (A/F) mixture in the combustion chamber 26, exhaust gas may be directed through an exhaust port 32 to an exhaust gas conduit 34 in communication with the turbine stage 14 of the turbocharger 12. An exhaust gas recirculation (EGR) system 36 may provides communication between the exhaust conduit 34 and the intake conduit 22 to recirculate controlled amounts of exhaust gas back into the intake air introduced into the engine. Exhaust gas flow through the EGR system 36 may be controlled by an exhaust gas recirculation valve 38.

The engine 10 may have an intake air mass flow sensor 40, or other means for measuring intake air mass flow, which may be disposed upstream of the compressor stage 16, and temperature sensor 42 may be disposed in the exhaust conduit 34 at a position upstream between the exhaust port 32 and the turbine stage 14 of the turbocharger 12. Additional temperature sensors 46 and 48 may be arranged to respectively sense the internal, i.e., substrate or other, temperature of the Diesel particulate filter 18 and/or $NO_x$ trap 20. Additionally, a crankshaft position sensor 50 may be incorporated to provide crankshaft position and engine speed signals to a programmable electronic engine control unit (ECU) 52. The intake air mass flow sensor 40, the pre-turbine exhaust gas temperature sensor 42, the post-turbine exhaust gas temperature sensor 44, and the DPF and LNT temperature sensors 46, 48 may be in electrical communication with the programmable ECU 52. In response to sensed signals, as described below in greater detail, the programmable ECU 52 may provide output signals to the fuel injector 30, the turbocharger 12, and the exhaust gas recirculation control valve 38.

The need for regeneration of the catalyst in the LNT 20 (e.g. desulfurization) and/or in the DPF 18, may be determined by a variety of methods. For example, regeneration may be indicated after a predetermined length of time of operation and/or fuel consumption and/or by a suitable sensor, not shown, positioned downstream of such devices. Separately considered, or in conjunction with monitoring time, and in the exemplary case of the DPF, one may monitor the pressure drop across the filter. By way of further example, when it may be determined that sulfur removal (desulfurization) is required in the LNT 20, the engine control module 52 may initiate a sequence of events such that incomplete combustion may be directed for one or more selected engine cylinders. Such determination may be based on engine load and speed which parameters may be provided by the intake air mass flow sensor 40, the injected fuel mass, and/or the crankshaft position sensor 50.

Incomplete combustion herein may be understood as a situation wherein, for a given cylinder or for a plurality of selected cylinders, a quantity (Q) of fuel may be introduced and the ECU may direct incomplete combustion. In such manner, the products of combustion from such cylinder may now include some quantity of non-combusted fuel, e.g., (0.50-1.0)Q, including all values and increments therein. For example, due to incomplete combustion in a given cylinder, the quantity of non-combusted fuel may be greater than about (0.70)Q. It may then be appreciated that the exhaust may specifically contain non-combusted hydrocarbon (HC) fuel compounds as well as carbon monoxide (CO) as well as other combustion by-products. Hydrocarbons (HCs) may be understood as any molecules that contain hydrogen and carbon, both of which are fuel molecules that can be combusted (oxidized) to form water ($H_2O$) or carbon dioxide ($CO_2$). When the combustion is incomplete it can be appreciated that carbon monoxide (CO) may also be formed. As CO can be burnt to produce $CO_2$, it may also serve as a fuel to increase the exothermic reactions and temperatures of a given catalyst bed.

In addition, it may be appreciated that due to incomplete combustion of the fuel at levels of 0.70-1.0(Q), the power output from a cylinder undergoing such incomplete combustion may be significantly reduced and the torque output from the engine may then be attributed mostly to those cylinders not undergoing such incomplete combustion. The present disclosure therefore provides a convenient method to adjust or select between incomplete and complete combustion. Complete combustion may be understood as that situation wherein about 70% or more of the fuel is combusted under conditions leaner than stoichiometric conditions. Stoichiometric conditions may be understood as that situation wherein the amount of oxidant in the reaction is just enough to completely burn the fuel.

With regards to the incomplete combustion that may be initiated herein in a given cylinder, or even within a selected number of cylinders in a given engine, it may be accomplished by a variety of techniques. For example, depending upon the amount (quantity) of exhaust gas recirculation (EGR) that may occur and be reported to the ECU 52, the injection timing may be adjusted in a given cylinder which thereby may provide a desired level of incomplete combustion. For example, the injection timing for detonation in a given cylinder may be retarded relative to the position of a piston. While this may result in lost power in such cylinder, it may also provide the requisite amount of incomplete combustion and unburned fuel that may then be employed downstream in a given exhaust device to increase the exhaust device temperature and regenerate a given catalyst bed.

It may then be appreciated that under those circumstances where there may be higher levels of exhaust gas selectively recycled into a given cylinder, the injection timing may be retarded a lesser amount than for that situation where the amount of recycled exhaust gas is relatively lower. The ECU 52 may then again provide a similar desired level of incomplete combustion with respect to any added fuel quantity. Furthermore, it may be appreciated that while the ECU 52 may regulate timing and selectively provide incomplete combustion to a desired cylinder or to a plurality of desired cylinders, the remaining cylinders may be subject to an adjustment in injection timing, sequence of injection per combustion event, fuel quantity and/or fuel pressure to address (e.g. increase) engine power output requirements.

Figure 2:
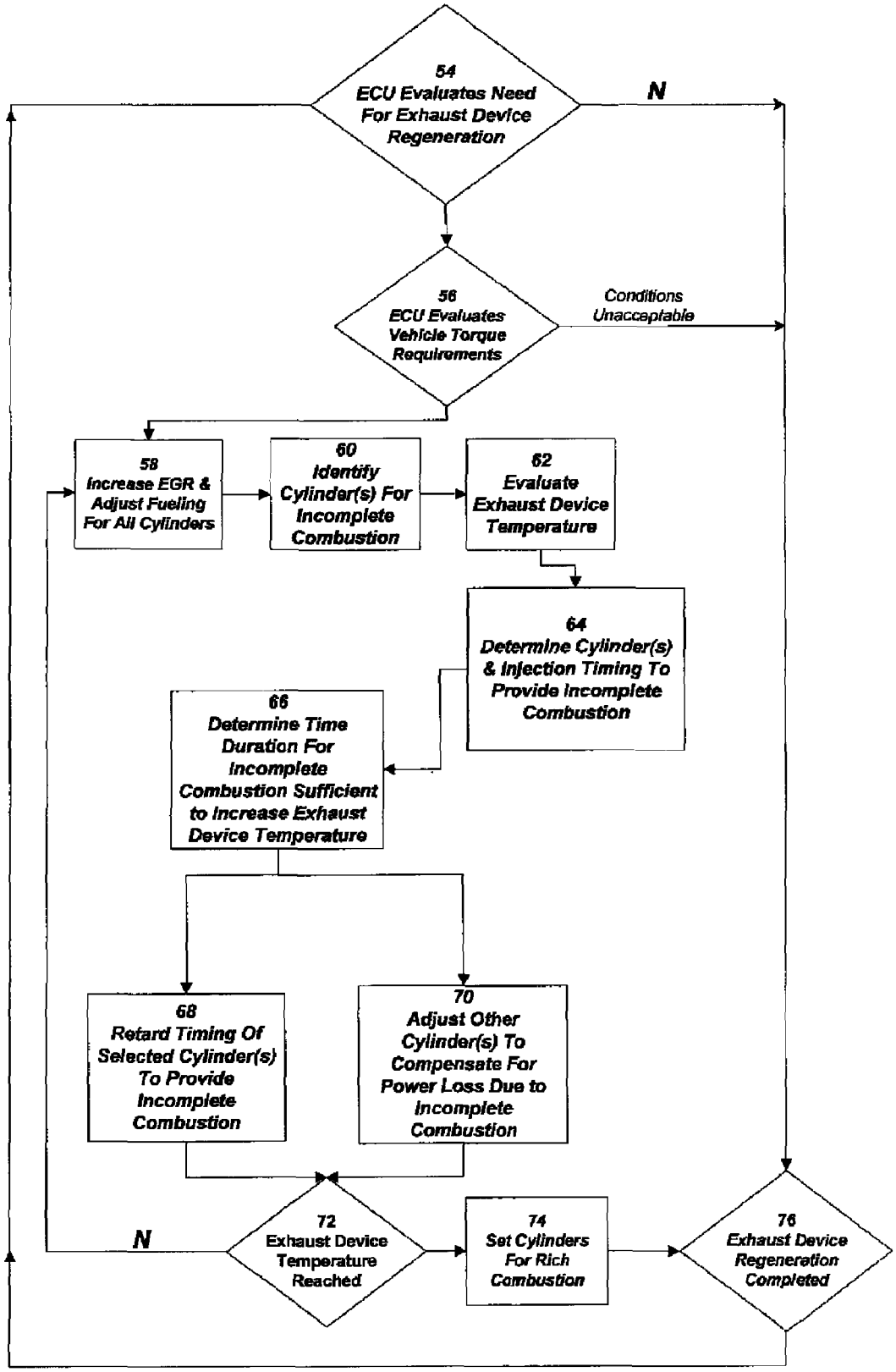
FIG. 2 illustrates an exemplary flow (decision) chart demonstrating engine control unit (ECU) management for exhaust device regeneration.

FIG. 2 provides an exemplary flow chart illustrating the implementation of an incomplete combustion in one or more cylinders which may then be relied upon to provide an increase in temperature of an exhaust gas treatment device. As an initial matter, the engine control unit (ECU) may first monitor and/or evaluate at 54 the need for regeneration of an exhaust device. As noted above, this may be based upon a predetermined length of time of engine operation and/or fuel consumption and or mileage and/or sensor feedback. If the ECU 52 identifies a need for regeneration of an exhaust gas treatment device, at 56 it may then consider the vehicle torque requirements. Under those circumstances where the vehicle torque requirements may still be maintained wherein one or a plurality of cylinders may be selectively configured for incomplete combustion, the ECU 52 may proceed at 58 to initiate an incomplete combustion protocol. Alternatively, if the conditions are unacceptable (e.g., the vehicle torque requirements may not be satisfied should an incomplete combustion protocol be employed) the ECU 52 may defer for a given time period to reevaluate engine torque requirements.

At 58 there may now be an increase in exhaust gas recirculation (EGR) along with an adjustment in fueling for the cylinders. At 60 there may be identification of one or a plurality of selected cylinders for incomplete combustion and at 62 there may be an evaluation of a given exhaust device temperature. In addition, although not directly illustrated, it may be appreciated that at 60 the ECU may also be programmed to alternate as to which cylinder or cylinders are selected for an incomplete combustion. It may be appreciated that this may then equalize the thermal stress experienced by all of the cylinders in a given internal combustion engine.

At 64 there may be a determination of the injection timing to provide incomplete combustion and at 66 there may be a determination of the appropriate time duration for an incomplete combustion sequence (e.g. the number of cylinder detonations for which incomplete combustion may be desired). This may then be followed by retarding the timing of the selected cylinder or cylinders to provide incomplete combustion and optionally, adjusting the injection timing in the other cylinders to compensate for any power loss (measured in horsepower) due to incomplete combustion. In addition, a command for the turbocharger to maintain a desired boost (increase in manifold pressure in the intake path) may be provided to meet a given boost level requirement, due to the reduced energy flow to the turbine from the engine exhaust manifold when there is incomplete combustion in one or more cylinders. This may involve adjusting the nozzle mechanism in order to change the vane angle of the nozzle, e.g., in a variable geometry turbocharger, so that the boost level may be maintained within 80% or more of the boost in the absence of incomplete combustion. It should also be appreciated that as a result of an incomplete combustion event herein, the pre-turbine temperature, which is associated with the average exhaust temperature of all cylinders, may be lower, which may then protect the turbocharger from thermal fatigue.

Accordingly, the horsepower output of an engine undergoing incomplete combustion in one or more selected cylinders may be remain substantially unchanged, which may be understood as providing a horsepower output that is no less than about 80% of the engine horsepower output in the absence of an incomplete combustion event. Accordingly, the engine herein configured to selective provide an incomplete combustion event in one or more given cylinders may still provide a power output that is within 80-100% of the power output of the engine in the absence of an incomplete combustion protocol, including all values and ranges therein.

The ECU may then continue to monitor a given exhaust device temperature and/or rate of change in temperature (T) with respect to a time (t). The ECU may also determine at 72 that a temperature has been achieved such that a given catalyst bed may be regenerated. This may then be followed at 74 by setting the cylinders for richer than or equal to stochiometric combustion and a determination at 76 that the exhaust device regeneration has been completed. It should be appreciated that the requirement to set the cylinders for richer than or equal to stoichiometric combustion at 74 is not required in the event that DPF regeneration is at issue.

Figure 3:
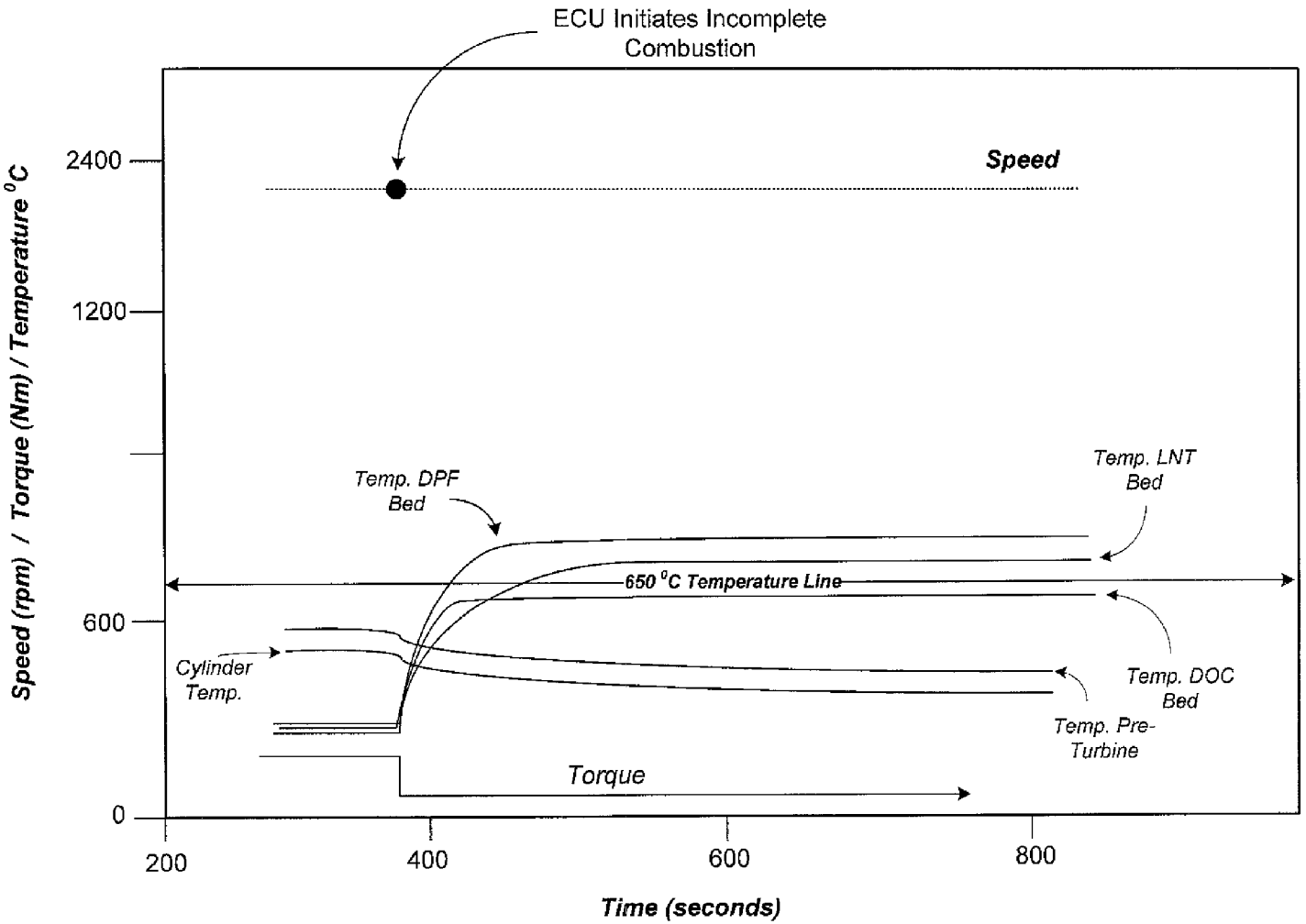
FIG. 3 graphically illustrates an incomplete combustion event and the effects of incomplete combustion products on the temperature of a lean nitrous oxide trap (LNT) and Diesel particulate filter (DPF).

FIG. 3 graphically illustrates the engine speed (revolutions per minute), torque (Newton-meters) and temperature (° C.) for an exemplary sequence in which the ECU elects to initiate incomplete combustion in two given cylinders of a multi-cylinder diesel engine (in this case a four-cylinder diesel engine). As can be seen, at the onset of an incomplete combustion event in two selected cylinders, the ECU may adjust the power output in the remaining cylinders to meet the desired torque demand. It should be noted that it may be less noticeable to the driver if the onset of the incomplete combustion is initiated at deceleration, with adjustment of the remaining cylinders to meet the desired torque. The hydrocarbons and/or CO from the cylinders with incomplete combustion may then be directed to, e.g., a diesel oxidation catalyst, catalyzed DPF and/or the lean nitrous oxide trap (LNT) and the temperature therein may increase due to the increase in exothermic reactions occurring therein. As shown, subsequent to the occurrence of incomplete combustion in selected cylinders, the temperature of the LNT catalytic bed was observed to increase in temperature from a temperature of about 375° C. to above a temperature of about 650° C. and to a temperature of about 700° C. As also shown in FIG. 3, the temperature of the diesel particulate filter (DPF) may also be observed to increase due to the introduction of the products of incomplete combustion. As can be seen, the DPF may initially be at a temperature of about 400° C. and in a manner similar to the LNT bed, increase to a temperature of greater than 650° C. and to a temperature of about 750° C. In addition, the temperature of the diesel oxidation catalyst (DOC) is also seen to increase from a temperature of about 375° C. to a temperature of about 600° C. Accordingly, the system herein is contemplated to provide an increase in an exhaust treatment device temperature ($\Delta T_{ETD}$) of 200° C. to 500° C., including all values and increments therein. In addition, as can be seen from FIG. 3, both the DPF bed and the LNT bed may increase to temperature at or above 650° C., which may then be suitable for catalyst regeneration.

Figure 4:
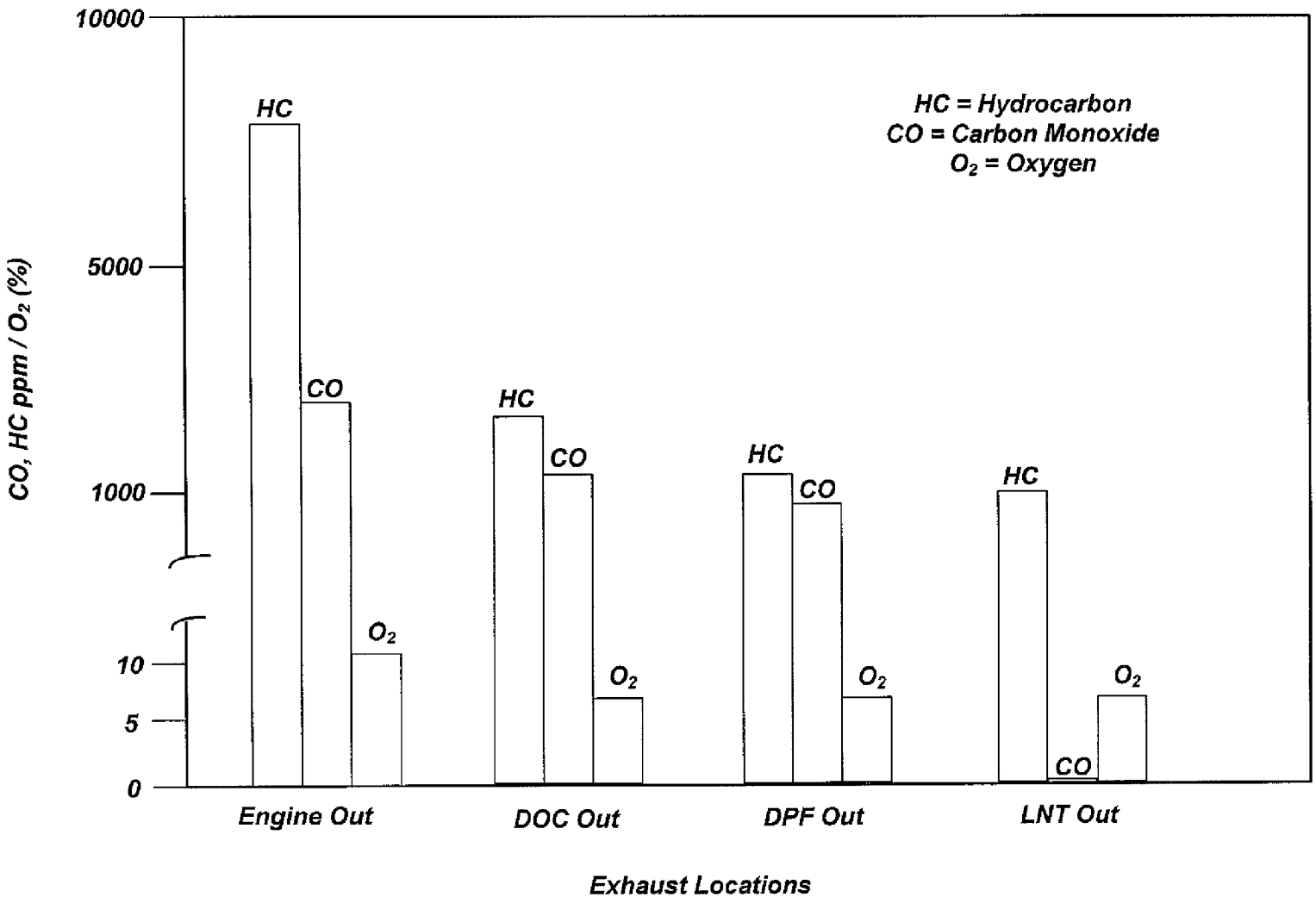
FIG. 4 graphically illustrates carbon monoxide, hydrocarbon and oxygen concentrations at various exhaust locations.

FIG. 4 illustrates the HC and CO concentrations at "engine out", "DOC out", "DPF out" and "LNT out" which may be understood as those locations where the exhaust gases may be exiting. In addition, FIG. 4 provides such concentration subsequent to a decision by the ECU to initiate incomplete combustion in the two selected cylinders of a four-cylinder diesel engine. As can be seen, after the diesel oxidation catalyst (DOC), both the hydrocarbon level and carbon monoxide level may be reduced (relative to the engine out location). However, the HC and CO may still be present in sufficient concentrations for the exothermic reactions in the diesel particulate filter (DPF) and lean nitrous oxide trap (LNT). As can be seen, the levels of HC that may be provided to the DPT and/or LNT may be at least about 750 ppm and the level of CO may be at least about 500 ppm. The incomplete combustion duration can also be calibrated so that the HC and CO flow through the tailpipe to the atmosphere is relatively minimal and satisfies regulatory requirements.

Figure 5:
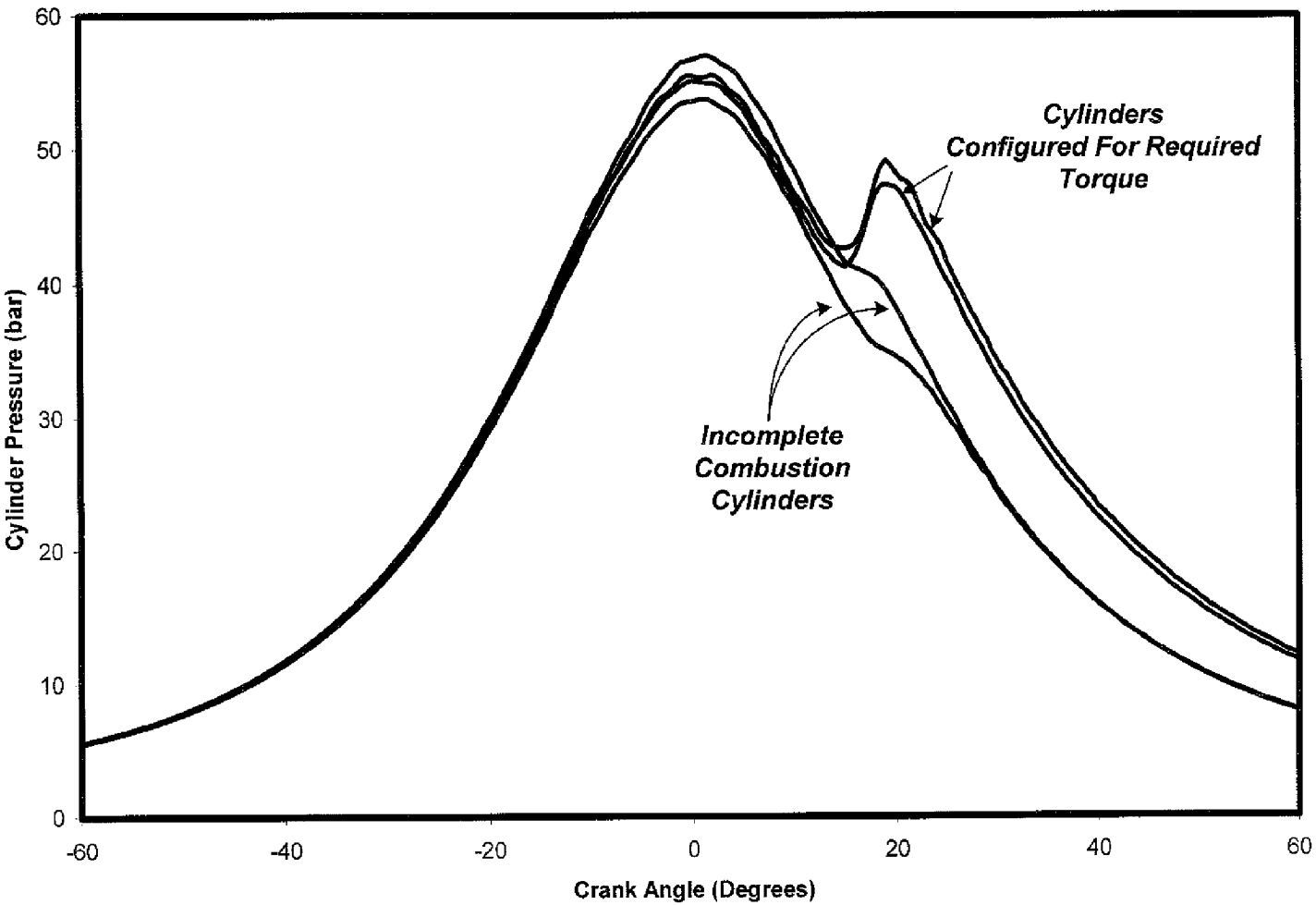
FIG. 5 illustrates cylinder pressure versus crank angle degree for cylinders undergoing incomplete combustion and cylinders which have been configured for increase power output.

Attention is next directed to FIG. 5, which illustrates the cylinder pressure versus crank angle degree for a four cylinder engine, which provides a method to follow the course of combustion. In FIG. 5, two of the cylinders have been selected for incomplete combustion as disclosed herein. For the arrow tips identifying the incomplete combustion cylinders, FIG. 5 shows that, after reaching the maximum cylinder pressure of about 55 psi. at the crank angle of about 0 degrees, the cylinder pressure continuously decreases to less than about 10 psi. at the crank angle of 60 degrees. In contrast to the cylinders configured for required torque, the location of the arrow tips on the pressure curve of the incomplete combustion cylinders highlight the portion of the curve where incomplete combustion of an air/fuel mixture is performed without increasing the cylinder pressure of the cylinder. As can be seen, the remaining two cylinders not undergoing incomplete combustion may be configured (e.g., via a timing adjustment and/or fuel quantity adjustment) to provide a required torque. As indicated by the arrow tips identifying cylinders configured for required torque (i.e. cylinders not undergoing incomplete combustion), after reaching a maximum cylinder pressure of about 55 psi. at a crank angle of about 0 degrees, the cylinder pressure begins to decrease to about 40 psi. before increasing to about 50 psi. at a crank angle of about 20 degrees. Thereafter, the pressure continuously decreases to about 10 psi. at a crank angle of 60 degrees. The location of the arrow tips on the pressure curve highlight the portion of the curve where the cylinder pressure increases at the crank angle of about 20 degrees.

It should also be appreciated that the functionality described herein for the various embodiments of the present invention (see e.g. FIG. 2) may be implemented by using hardware, software, firmware or a combination thereof, either within the processor, engine control unit (ECU), a computer or other device, as desired. If implemented by software, a processor and a machine readable medium are required. The processor may be of any type of processor capable of providing the speed and functionality required by the embodiments of this disclosure. Machine-readable medium may includes any memory capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that may store digital information. The instructions may be stored on medium in either a compressed and/or encrypted format.

Accordingly, in the broad context of the present invention, and with attention to FIG. 3, the engine control unit (ECU), for example, may contain a processor and machine readable media and a user interface. It should be appreciated that the user interface may be any interface that the user has with the ECU, or any device that may be in communication with the ECU in which the user may input information. Therefore, the system herein may be a combination of the article of machine readable media including instructions thereon which may provide the functionality described herein in combination with typical engine components that may be used in an internal combustion (gasoline or Diesel) engine. Thus, in the broad context of the present disclosure, a system may be provided wherein a cylinder or a plurality of cylinders in a given engine may receive instructions that are provided by the machine readable media to undergo incomplete combustion, and to maintain such incomplete combustion for a period of time to achieve a desired level of temperature increase in a selected exhaust treatment device.

The foregoing description is provided to illustrate and explain the present invention. However, the description hereinabove should not be considered to limit the scope of the invention set forth in the claims appended hereto.

What is claimed is:

1. A method for increasing the temperature of an engine exhaust treatment device comprising:

a. selectively providing incomplete combustion of an air/fuel mixture in a cylinder of an internal combustion engine without increasing a cylinder pressure of the cylinder, said incomplete combustion comprising introducing into said cylinder a quantity of fuel (Q) wherein products of said incomplete combustion comprise (0.5-1.0)(Q);

b. directing products of said incomplete combustion to an engine exhaust treatment device, said engine exhaust treatment device comprising a catalyst;

c. exposing said engine exhaust treatment device to said products of incomplete combustion, wherein said products comprise a non-combusted hydrocarbon compound; and d. increasing the temperature of said engine exhaust treatment device in an amount of about 200° to about 500° C. due to exposure of said engine exhaust treatment device to the non-combusted hydrocarbon compound and reacting therein, wherein the temperature of said exhaust treatment device is increased to a temperature suitable for a regeneration of said catalyst.

2. The method of claim 1 wherein said increasing of temperature of said engine exhaust treatment device comprises increasing the temperature of said device to a temperature in the range of about 600° C. to about 700° C.

3. The method of claim 1 wherein incomplete combustion is provided by adjusting the amount of exhaust gas in said cylinder.

4. The method of claim 1 wherein incomplete combustion is provided by adjusting the amount of air in said cylinder.

5. The method of claim 1 wherein incomplete combustion is provided by adjusting the pressure of intake air in said cylinder.

6. The method of claim 1 carried out in an internal combustion engine having an injection timing setting wherein said providing of incomplete combustion in said cylinder comprises adjusting said injection timing.

7. The method of claim 1 wherein said internal combustion engine includes a plurality of cylinder and the cylinders in said internal combustion engine not undergoing incomplete combustion have a power output and said power output is increased.

8. The method of claim 7 wherein said power output is of said internal combustion engine is at least 80% of said power output in the absence of incomplete combustion.

9. The method of claim 7 wherein said internal combustion engine includes a turbocharger providing a boost level that is about 80% of more of the boost in the absence of incomplete combustion.

10. The method of claim 1 wherein said exhaust treatment device comprises a nitrous oxide ($NO_x$) trap capable of adsorbing nitric oxide compounds.

11. The method of claim 1 wherein said exhaust treatment device comprises a diesel particulate filter (DPF).

12. A method for increasing the temperature of an engine exhaust treatment device comprising:

a. selectively providing incomplete combustion of an air/fuel mixture in a cylinder of a multi-cylinder internal combustion engine without increasing a cylinder pressure of the cylinder, said incomplete combustion comprising introducing into said cylinder a quantity of fuel (Q) wherein products of said incomplete combustion comprise (0.5-1.0)(Q);

b. directing products of said incomplete combustion to an engine exhaust treatment device, said engine exhaust treatment device comprising a catalyst;

c. exposing said engine exhaust treatment device to said products of incomplete combustion, wherein said products comprise a non-combusted hydrocarbon compound; and d. increasing the temperature of said engine exhaust treatment device in an amount of about 200° to about 500° C. due to exposure of said engine exhaust treatment device to the non-combusted hydrocarbon compound and reacting therein, wherein the temperature of said exhaust treatment device is increased to a temperature suitable for a regeneration of the catalyst.

13. The method of claim 12 carried out in an internal combustion engine having an injection timing setting wherein said providing of incomplete combustion in at least one cylinder comprises adjusting said injection timing.

14. The method of claim 12 wherein said exhaust treatment device comprises a nitrous oxide ($NO_x$) trap capable of adsorbing nitrous oxide compounds.

15. The method of claim 12 wherein said exhaust treatment device comprises a diesel particulate filter (DPF).

16. The method of claim 12 wherein said exhaust treatment device comprises a nitrous oxide ($NO_x$) trap capable of adsorbing nitric oxide compounds.

17. A computer program product residing on a tangible computer readable medium having a plurality of instructions stored thereon which, when executed by a processor, cause the processor to:

a. monitor an exhaust treatment device (ETD), said engine exhaust treatment device comprising a catalyst;

b. instruct for incomplete combustion of an air/fuel mixture in a cylinder of a multi-cylinder internal combustion engine, without increasing a cylinder pressure of the cylinder, to produce products of said incomplete combustion, wherein said products comprise a non-combusted hydrocarbon compound; and said incomplete combustion comprising introducing into said cylinder a quantity of fuel (Q) wherein the products of said incomplete combustion comprise (0.5-1.0)(Q); and c. identify if an increase in temperature has occurred in said exhaust treatment device due to exposure of said engine exhaust treatment device to the non-combusted hydrocarbon compound and reacting therein, wherein the temperature of said exhaust treatment device is increased in an amount of 200° C. to 500° C. for a regeneration of the catalyst.

18. The computer program product of claim 17 wherein said processor monitors an ETD temperature or rate of change in temperature versus time.

19. The computer program product of claim 17 wherein said processor monitors the duration of incomplete combustion in said cylinder.

20. The computer program product of claim 17 wherein said processor instructs for incomplete combustion in said cylinder by adjusting one or more of:

a. fuel quantity in said cylinder;

b. amount of air in said cylinder c. pressure of intake air in said cylinder; and d. amount of exhaust gas in said cylinder.

21. The computer readable medium of claim 17 wherein said processor:

monitors vehicle torque requirements and identifies whether said vehicle torque requirements can be maintained under circumstances where one or more cylinders undergo incomplete combustion.

22. The computer readable medium of claim 17 wherein said processor monitors injection timing for an engine and said instruction for incomplete combustion comprises adjusting injection timing in one or a plurality of engine cylinders.

23. The computer readable medium of claim 17 wherein said processor:

identifies one or more of the variables of time of an engine operation, pressure at a selected location, fuel consumption or vehicle mileage, and based upon said monitoring of one or more of said variables said processor instructs for incomplete combustion in a cylinder of an internal combustion engine.

24. The computer readable medium of claim 17 wherein said processor:

monitors information regarding which of a plurality of cylinders have undergone incomplete combustion and evaluates said information prior to instructing for incomplete combustion.

25. The computer readable medium of claim 17 wherein said exhaust treatment device comprises one of a nitrous oxide ($NO_x$) trap capable of adsorbing nitrous oxide compounds and a diesel particulate filter (DPF).

* * * * *